US006015149A

United States Patent [19]

Burk

[11] Patent Number: 6,015,149

[45] Date of Patent: Jan. 18, 2000

[54] CARD STACKING GAME

[76] Inventor: Kent P. Burk, 616 W. Baseline, Tempe, Ariz. 85283

[21] Appl. No.: 09/027,390

[22] Filed: Feb. 2, 1998

[51] Int. Cl.[7] ..... A63F 1/00; A63H 33/08

[52] U.S. Cl. ..... 273/148 A; 446/111; 446/112

[58] Field of Search ..... 273/148 R, 148 A; 446/112, 124, 108, 111, 114, 115, 116

[56] References Cited

U.S. PATENT DOCUMENTS

| | | | |
|---|---|---|---|
| 1,487,102 | 3/1924 | Hodgson | 446/112 |
| 3,747,262 | 7/1973 | Endres | 446/112 |
| 3,827,177 | 8/1974 | Wengel | 446/116 |
| 3,998,002 | 12/1976 | Nathanson | 446/115 |
| 4,270,302 | 6/1981 | Dandia | 446/112 X |
| 4,334,868 | 6/1982 | Levinrad | 446/112 X |
| 4,365,454 | 12/1982 | Davis | 446/112 X |
| 4,969,568 | 11/1990 | Yoshida | 446/111 X |
| 5,423,709 | 6/1995 | Summers | 446/108 X |
| 5,487,690 | 1/1996 | Stoffle et al. | 446/108 X |

FOREIGN PATENT DOCUMENTS

| | | | |
|---|---|---|---|
| 1027845 | 5/1953 | France | 446/112 |

*Primary Examiner*—Raleigh W. Chiu
*Attorney, Agent, or Firm*—Tod R. Nissle, P.C.

[57] ABSTRACT

A card game in which cards can be readily assembled and disassembled from a wide variety of three dimensional structures. The game includes card holders which enable cards to be assembled into a structure with card extending along several axes normal to one another and with a plurality of cards extending vertically upward from a support surface.

1 Claim, 3 Drawing Sheets

FIG. 3
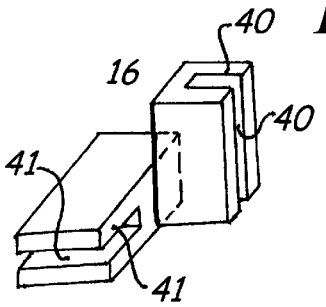
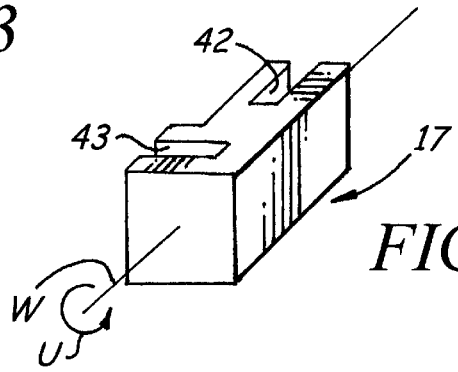
FIG. 4
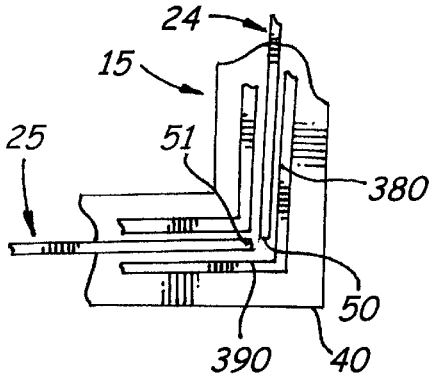
FIG. 2
FIG. 5
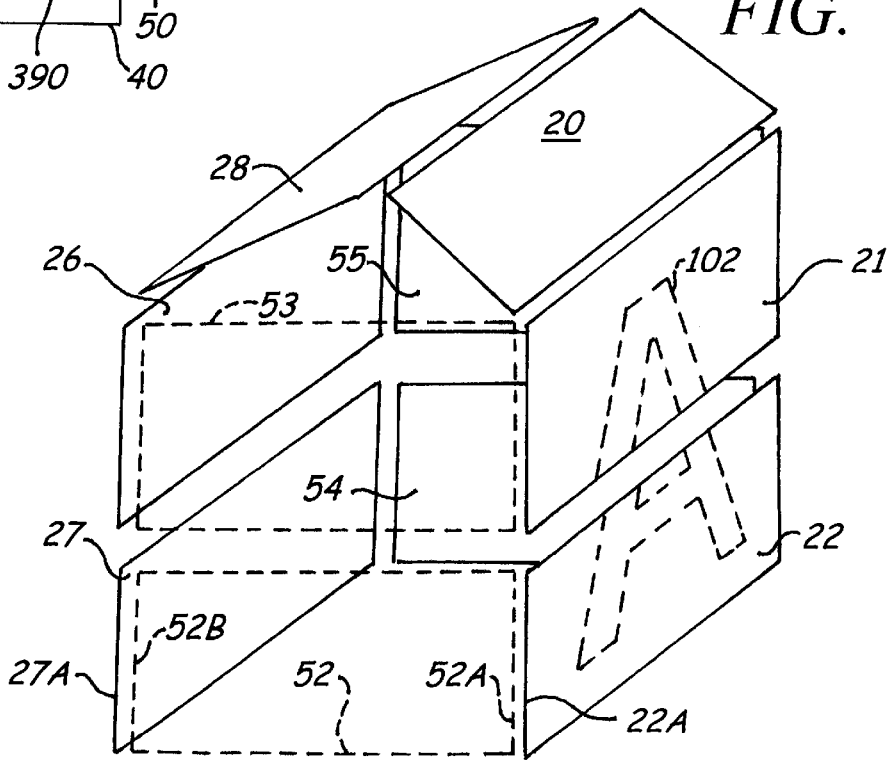

CARD STACKING GAME

This invention relates to games.

More particularly, the invention relates to a game in which cards can be readily assembled into and disassembled from a wide variety of three dimensional structures.

Construction games have long been available which include parts that can be assembled to form a structure. Such games are advantageous because they increase manual dexterity, improve hand-eye coordination, and exercise the imagination of an individual. Examples of such games include TINKER TOYS™, LEGO™ blocks, ERECTOR SETS™, and simply, wooden blocks. While such games have successfully been utilized for many ears, none of the games permit the ready, safe assembly of thin panels or sheets of material into walls, buildings and other structures which can be easily disassembled. The ready assembly of thin panels of material is advantageous because such panels can be imprinted with a variety of designs and illustrations. A group of cards when assembled in a particular order or pattern can illustrate an animal, a word, a letter, or any other desired object, thing, design, symbol or character. For example, four rectangular cards can each be imprinted on one side such that when the cards are placed on and contact a flat surface next to each other to form a larger rectangle (an edge of each one pair of the cards adjacent an edge of one of the other pair of cards such that each of the four cards comprises one-fourth of the area of the larger rectangle), the imprinting on each of the cards collectively illustrates a panda. Or, such a word, letter, object, etc. can be illustrated in its entirety on a single panel of material. Another advantage of using thin panels of material to assemble a structure is that thin panels take up a minimal amount of storage space when the structure is disassembled.

Accordingly, it would be highly desirable to provide an improved construction game in which thin panels of material can be assembled to form free standing three dimensional structures, and, can be readily disassembled for storage.

Therefore, it is a principal object of the invention to provide an improved game.

A further object of the invention is to provide an improved game which enables thin panels of material to be used to construct a structure which completely encloses a space.

These and other further and more specific objects and advantages of the invention will be apparent to those skilled in the art from the following detailed description thereof, take in conjunction with the drawings, in which:

FIG. 2 illustrates a card holder constructed in accordance with the invention;

FIG. 3 illustrates another card holder constructed in accordance with the invention;

FIG. 4 illustrates still another card holder or clip constructed in accordance with the invention;

FIG. 5 illustrates the orientation of cards in a structure constructed in accordance with the invention; and, FIG. 6 illustrates another embodiment of the invention.

Figure 1:
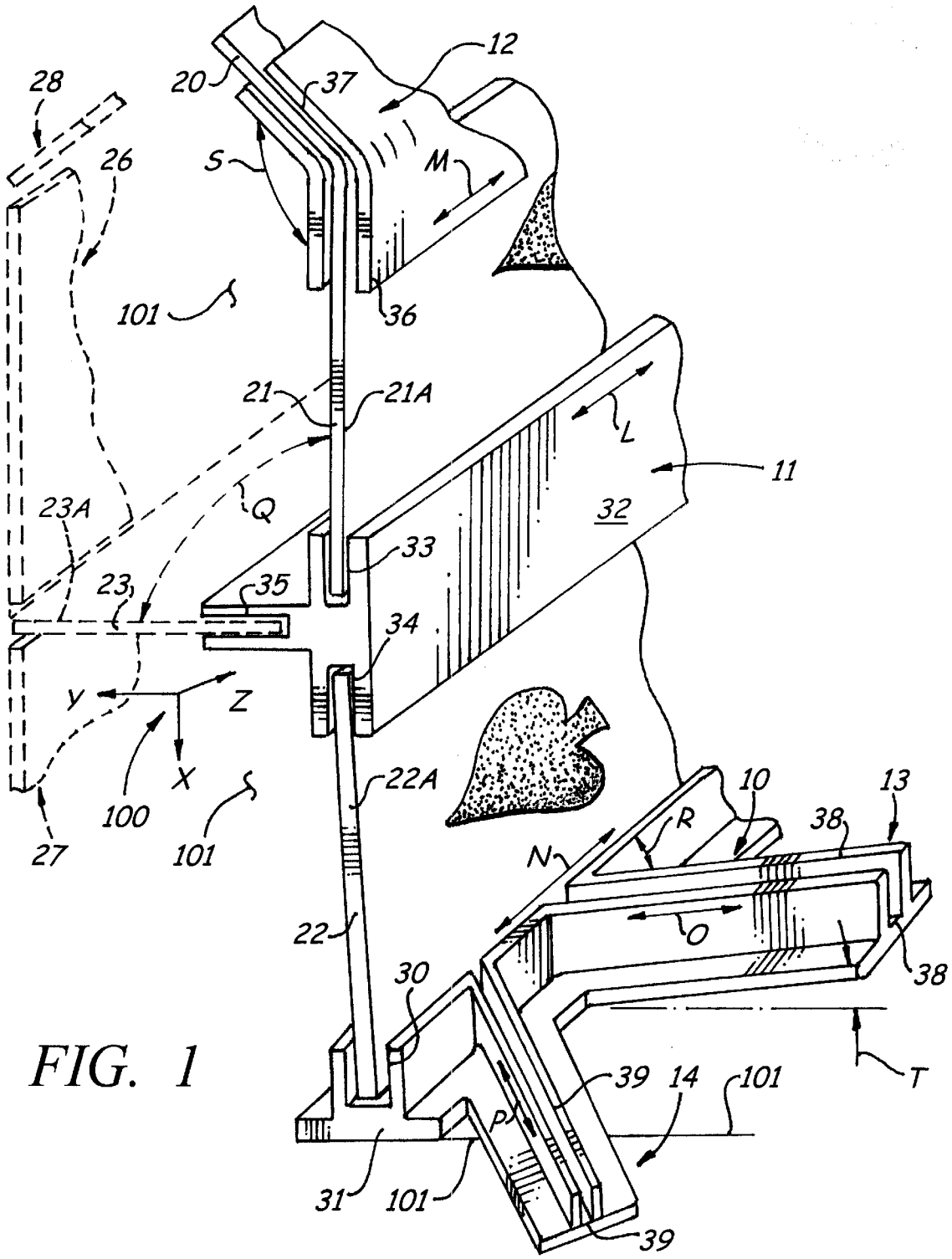
FIG. 1 illustrates a game structure assembled in accordance with the principles of the invention.

Briefly, in accordance with my invention, I provide an improved construction game comprising a card stacking game for constructing a three dimensional structure of cards stacked horizontally and vertically. The game includes a plurality of cards; and, a plurality of card holders shaped and dimensioned to stack a plurality of said cards in a substantially vertical orientation one on top of the other, and to stack a plurality of said cards in a substantially horizontal orientation one next to the other. The cards in the substantially horizontal orientation are canted with respect to the cards in the substantially vertical orientation.

In accordance with another embodiment of my invention, I provide a card stacking game for constructing a three dimensional structure of cards. The game includes a plurality of cards each having a peripheral edge; and, a plurality of card holders shaped and dimensioned to stack a plurality of the cards each in a first orientation, and to stack a plurality of the cards each in a second orientation with the peripheral edge of each of the cards the second orientation adjacent the peripheral edge of one of at least one of the cards in the first orientation. The cards in the second orientation are canted with respect to the cards in the first orientation.

In a further embodiment of my invention, I provide a card stacking game for constructing a three dimensional structure of cards. The game includes a plurality of cards each having a peripheral edge; a first card holder shaped and dimensioned to set on a support surface and slidably receive and support at least a first one of the cards in a substantially vertical orientation such that a portion of said peripheral edge of the first one of the cards is positioned above the first card holder and the surface; and, a second card holder shaped and dimensioned to slidably engage the portion of the peripheral edge of the first one of the cards to slidably receive a portion of the peripheral edge of a second one of the cards such that the second card is orientated above the support surface.

In still another embodiment of my invention, I provide a card stacking game for constructing a three dimensional structure of cards. The game includes a plurality of cards; and, a plurality of card holders shaped and dimensioned to construct on a support surface a structure of the cards and holders. The structure includes at least three vertically oriented sides circumscribing and enclosing a space and a top extending over the space.

In yet a further embodiment of my invention, I provide a card stacking game for constructing a three dimensional structure of cards each stacked in an orientation substantially parallel to a pair of first, second, and third axes; the first, second and third axes each being normal to the remaining pair of the axes. The game includes a plurality of cards; and, a plurality of card holders. The card holders are shaped and dimensioned to position at least one of the cards substantially parallel the first and second axes; at least one of the cards substantially parallel to the second and third axes; and, at least one of the cards substantially parallel to the first and third axes.

In yet still another embodiment of my invention, I provide a method of forming a three dimensional game structure. The method includes the steps of providing a plurality of cards; providing a plurality of card holders shaped and dimensioned to slidably engage the cards; and, assembling the cards and card holders.

Turning now to the drawings, which depict the presently preferred embodiments of the invention for purposes of illustrating the invention and not by way of limitation of the scope of the invention, FIG. 1 illustrates a three dimensional structure of cards constructed in accordance with the principles of the invention and including a plurality of cards 20, 21, 22 and a plurality of card holders, 10, 11, 12 each including U-shaped grooves, 36, 37, 33, 34 and/or 30 shaped and dimensioned to engage a portion of the peripheral edge of one of the cards 20 to 22.

The shape and dimension of cards 20 to 22 can vary as desired, as can the information or data imprinted or formed on either side of a card 20 to 22. However, for sake of the following discussion, it is assumed that cards 20 to 22 each comprise a card from a conventional deck of playing cards. Card 21 is the ace of diamonds. Card 22 is the ace of spades. Each card 20 to 22 in FIG. 1 has a generally rectangular shape and, accordingly, has a peripheral edge consisting of four sides. The four sides include a first parallel pair of spaced apart sides normal to a second parallel pair of spaced apart sides.

Card holder 12 includes U-shaped grooves 36 and 37 each extending laterally in the directions indicated by arrows M. Grooves 36 and 37 can loosely or snugly removably receive at least a portion of the side of a playing card 20, 21. It is presently preferred that grooves 36 and 37 each snugly fictionally slidably removably receive at least one side of a playing card 20, 21.

Card holder 11 includes U-shaped grooves 33 to 35 each extending laterally in the directions indicated by arrows L. Grooves 33 to 35 can loosely or snugly removably receive at least a portion of the side of a playing card 21 to 23. It is presently preferred that grooves 33 and 34 each snugly frictionally slidably removably receive the side of a playing card 21 to 23.

Card holder 10 includes U-shaped groove 30 extending laterally in the directions indicated by arrows N. Groove 30 can loosely or snugly removably receive at least a portion of the side of a playing card 22. It is presently preferred that grooves 30 and 34 each snugly frictionally slidably removably receive the side of a playing card 22. A groove 30, 34 can be provided with adhesive or other means for removably or fixedly securing the side of a playing card in the groove.

Card holder 13 is integrally formed with card holder 10 and includes U-shaped groove 38 extending laterally in the directions indicated by arrows O. Groove 38 can loosely or snugly removably receive at least a portion of the side of a playing card.

Card holder 14 is integrally formed with card holder 10 and includes U-shaped groove 39 extending laterally in the directions indicated by arrows P. Groove 39 can loosely or snugly removably receive at least a portion of the side of a playing card.

If desired, grooves 30, 33 to 39 can include adhesive or can be otherwise formed to permanently contact and anchor the side of a playing card inserted in said grooves. It is, as earlier noted, presently preferred that the side of a card be susceptible to being removably frictionally slid into a groove 30, 33 to 39.

In FIG. 1, playing cards 21 and 22 are stacked vertically one on top of the other and are parallel to the X and Z axes shown by the axis diagram identified by reference character 100. Playing card 23 is horizontally oriented, is perpendicular and canted with respect to cards 21 and 22, and is parallel to axes Y and Z in the axis diagram identified by reference character 100. Card 20 is canted with respect to cards 21, 22, and 23. Cards 21 and 22 comprise one wall enclosing a space 101. Card 20 comprises a top extending over space 101. Another pair of playing cards, depicted by dashed lines 26 and 27, can be stacked one on top of the other (utilizing another set of card holders 10 to 12) to form a second wall which encloses space 101 and which is spaced apart from and parallel to the wall formed by cards 21 and 22.

Space 101 can be further enclosed by utilizing vertically stacked playing card pairs 52-53 and 54-55 (FIG. 5) to form "end" walls. For example, card 52 can be installed by (a) sliding U-shaped groove 42 of a first clip 17 over side 22A of card 22 such that groove 43 opens to the left in the manner illustrated in FIG. 4 (i.e., clip 17 is in the orientation illustrated in FIG. 4), (b) sliding U-shaped groove 42 of a second clip 17 over side 27A of card 27 (FIG. 5) such that groove 43 opens to the right (such that card 27 is in the orientation illustrated in FIG. 5 and clip 17 is in an orientation achieved by rotating clip 17 in FIG. 4 180 degrees about axis W in the direction indicated by arrow U), and (c) sliding sides 52A and 52B into U-shaped grooves 43 of the first and second clips 17 such that card 52 is in the position illustrated in FIG. 5 with respect to cards 22, 27 and with respect to the remainder of the cards in FIG. 5.

FIG. 5 illustrates the relative positions of each of the cards 20 to 22, 26 to 28, 52 to 55 after card holders or clips 10 to 12, 17 are utilized in the manner described above to form a structure of cards. The card holders or clips 10 to 12, 17 are omitted from FIG. 5 for the sake of clarity.

FIG. 3 illustrates an alternate card holder 16 including U-shaped grooves 40 and 41 which are shaped and dimensioned to frictionally slidably engage the side of a playing card or other card.

FIG. 2 also illustrates an alternate card holder including a base 40 and U-shaped grooves 380 and 390 each shaped and dimensioned to frictionally slidably engage the side of a rectangular playing card 24, 25, respectively, such that the ends 50 and 51 of the cards are adjacent and/or touching one another.

In FIG. 1, base 31 of card holder 10 sets on a horizontal surface 101. In contrast, card holder 13 tilts upwardly away from surface 101 through an angle indicated by arrows T. The angle between groves 36 and 37 of card holder 12 is indicated by arrows S. The angle between grooves 33 and 35 (and between cards 21 and 23) is indicated by arrows Q and is presently preferably ninety degrees, although this angle can vary as desired.

When the sides of a pair of rectangular playing cards are slidably inserted in grooves 40 and 41 in clip 16 in FIG. 3, the sides of the cards inserted in grooves 40 and 41 are perpendicular to one another. When the sides of a rectangular pair of cards are inserted in grooves 42 and 43 in the clip 17 of FIG. 4, the sides of the cards inserted in grooves 42 and 43 are parallel to one another. When rectangular playing cards 24 and 25 are inserted in grooves 380 and 390 in the manner illustrated in FIG. 2. The angle between cards 24 and 25 and grooves 380 and 390 is presently preferably ninety degrees, although this angle can vary as desired.

When the sides of a pair of rectangular playing cards are slidably inserted in grooves 40 and 41 in clip 16 in FIG. 3, the sides of the cards inserted in grooves 40 and 41 are perpendicular to one another. When the sides of a rectangular pair of cards are inserted in grooves 42 and 43 in the clip 17 of FIG. 4, the sides of the cards inserted in grooves 42 and 43 are parallel to one another. When rectangular playing cards 24 and 25 are inserted in grooves 380 and 390 in the manner illustrated in FIG. 2, cards 24 and 25 are perpendicular to one another while ends (or sides) 50 and 51 are parallel to one another. In FIG. 1, side 23A is perpendicular to side 22A; and, card 23 is perpendicular to card 22. Sides 21A and 22A and cards 21 and 22 are all parallel to one another.

In FIG. 5, the letter "A" is formed in part on and extends over an outwardly facing rectangular surface of each of adjacent cards 21 and 22.

Figure 6:
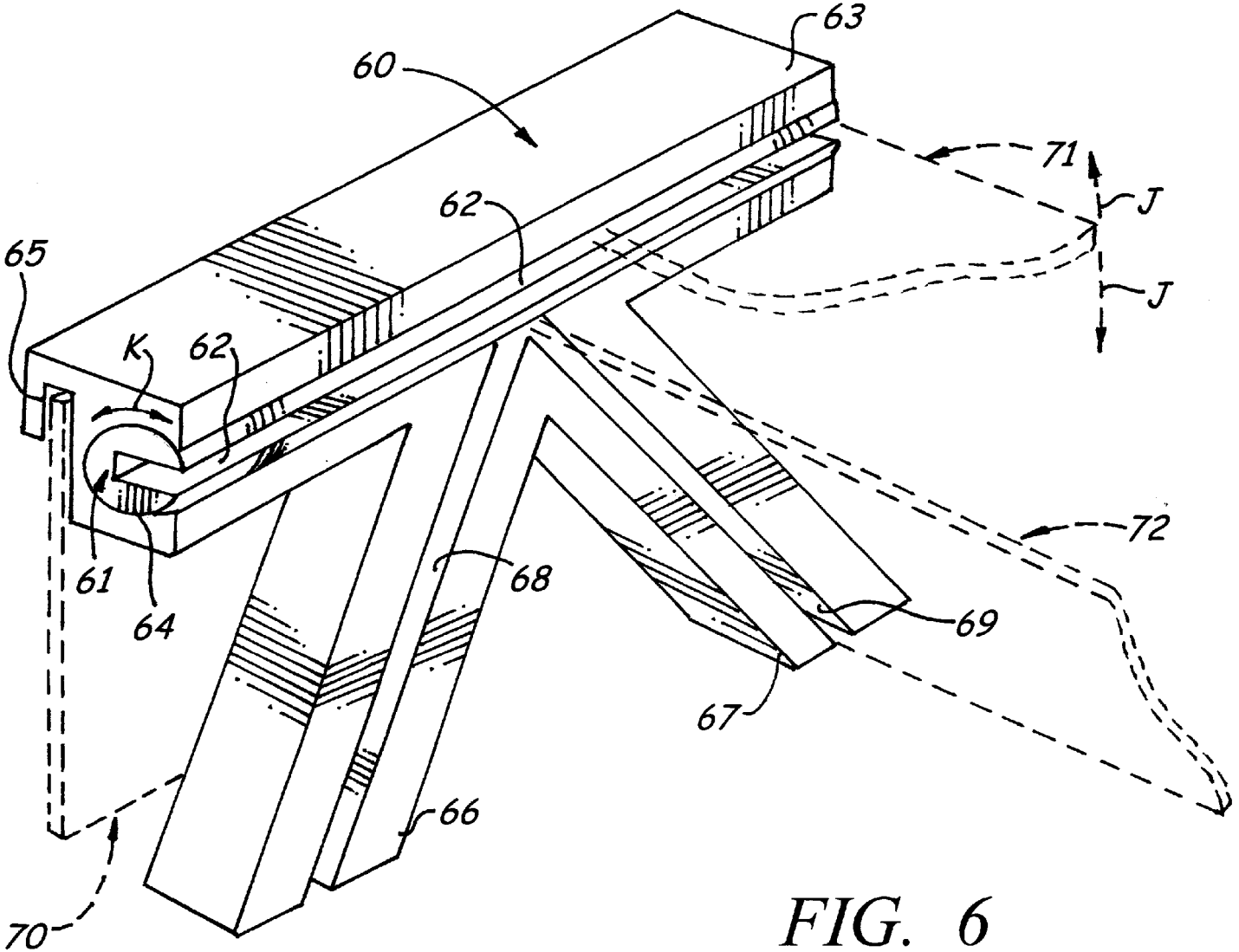

The "A-frame" card holder 60 illustrated in FIG. 6 includes legs 66 and 67 and header 63. Elongate card-receiving U-shaped grooves 68, 69, and 65 are formed in leg 66, leg 67, and header 63, respectively. Elongate card-receiving groove 62 is formed in cylindrical member 61. Member 61 is pivotally inset in cylindrical groove 64 in header 63. Member 61 can rotate in groove 64 in the directions indicated by arrows K such that the orientation of a card 71 having an edge slidably removably inserted in horizontally oriented groove 62 can be altered by grasping card 71 and pivoting card 71 up or down in the direction of arrows J to cause member 61 to pivot in the directions indicated by arrows K simultaneously with the pivoting of card 71 in the direction of arrows J. FIG. 6 illustrates in ghost outline a canted card 72 having an edge slidably removably inserted in canted groove 69. Vertically oriented card 70 includes an edge slidably removably inserted in elongate horizontally oriented groove 65 to maintain card 70 in the orientation illustrated in FIG. 6.

One advantage of the "A-frame" card holder 60 is that a second identical holder 60 can be stacked on the holder 60 of FIG. 5 simply by setting the second holder 60 on top of header 63 such that the spatial orientation of each holder 60 is identical. Another advantage of the holder 60 is that the different orientation of each groove 62, 65, 68 and 69 permits cards to be secured in member 60 in any of a variety of different orientations. The orientation of card 71 is different from that of card 72 and from that of card 70.

The card stacking game of the invention facilitates the ready and safe assembly and disassembly of cards into three dimensional panel structures of varying shape and dimension.

Having described my invention in such terms as to enable those skilled in the art to understand and practice it, and having identified the presently preferred embodiments thereof, I claim:

1. A card stacking game for constructing a structure of cards, including (a) a plurality of cards; and, (b) a card holder shaped and dimensioned to receive at least one of said cards and including at least one movable part which permits the orientation of said one of said cards to be altered.

* * * * *